US005520277A

United States Patent [19]

Alvord

[11] Patent Number: 5,520,277

[45] Date of Patent: May 28, 1996

[54] CONTACT LENS HOLDING DEVICE

[75] Inventor: Larry A. Alvord, Lawrenceville, Ga.

[73] Assignee: Ciba-Geigy Corporation, Tarrytown, N.Y.

[21] Appl. No.: 430,773

[22] Filed: Apr. 28, 1995

Related U.S. Application Data

[63] Continuation of Ser. No. 179,895, Jan. 10, 1994, abandoned, which is a continuation of Ser. No. 106,491, Aug. 11, 1993, abandoned, which is a continuation of Ser. No. 896,270, Jun. 10, 1992, abandoned.

[51] Int. Cl.[6] ..... A45C 11/04

[52] U.S. Cl. ..... 206/5.1; 134/901

[58] Field of Search ..... 206/5.1, 6; 134/901; 220/23.8, 23.2, 23.83, 4.01, 339

[56] References Cited

U.S. PATENT DOCUMENTS

| | | | |
|---|---|---|---|
| 3,007,566 | 11/1961 | Morris | 134/901 X |
| 3,645,284 | 2/1972 | Krezanoski et al. | 206/5.1 |
| 3,741,377 | 6/1973 | Krellen | 220/339 X |
| 3,768,633 | 10/1973 | Nathan | 206/5.1 X |
| 3,997,049 | 12/1976 | Sherman . | |
| 4,011,941 | 3/1977 | Parsons et al. | 206/5.1 |
| 4,396,583 | 8/1983 | Le Boeuf | 206/5.1 X |
| 4,750,610 | 6/1988 | Ryder | 206/5.1 |
| 4,890,729 | 1/1990 | Ranalletta | 206/5.1 |

FOREIGN PATENT DOCUMENTS

| | | |
|---|---|---|
| 2174913 | 10/1973 | France . |
| 2034497 | 6/1980 | United Kingdom . |

*Primary Examiner*—Jacob K. Ackun

*Attorney, Agent, or Firm*—Edward McC. Roberts; R. Scott Meece

[57] ABSTRACT

A contact lens holding device for use in a disinfecting system having a single-molded piece, the piece having a dividing portion having first and second surfaces, a first basket portion integrally attached to and capable of folding into closable engagement with the first surface of the dividing portion to form a first lens enclosure, and a second basket portion integrally attached to and capable of folding into closable engagement with the second surface of the dividing portion to form a second lens enclosure, the dividing portion, first basket portion and second basket portion lying on a substantially single plane when in unfolded configuration.

17 Claims, 4 Drawing Sheets

CONTACT LENS HOLDING DEVICE

This application is a continuation, of application Ser. No. 08/179,895, filed Jan. 10, 1994 which is a continuation of application Ser. No. 08/106,491, filed Aug. 11, 1993, which is a continuation of application Ser. No. 07/896,270 filed Jun. 10, 1992, all now abandoned.

The present invention relates to the field of contact lenses, and more particularly to a single piece contact lens holding device for use in a contact lens disinfection system.

One method of disinfecting contact lenses involves placing each lens in a solution containing hydrogen peroxide, and then neutralizing the solution using a catalyst. The method is typically performed by placing the lenses in a complicated system, in which a multipiece basket assembly is placed in a cup-like container holding the disinfecting solution and catalyst. The system and method is described in more detail in U.S. Pat. No. 4,011,941 to Parsons, incorporated herein by reference.

A problem exists, however, in that basket 40 assemblies have, to date, consisted of a number of separately molded parts which have been manually pieced together. Typically, a pair of individually molded basket 40s are snap-fitted to a main portion, which in turn is attached by a stem portion to the cap of the disinfection container. Such a complicated assembly results in increased manufacturing time and the need for a large amount of manual labor, often compounded by assembly line down time caused by a shortage of an individual component. In addition, because disinfection systems are often handled roughly during shipping, on store shelves or in travelling cases, handbags or such, the snap-fitted parts of the basket 40 assemblies often break apart. The result is a fragile, yet expensive assembly which is not well suited for use in a low cost, high voltage disposable disinfection system.

Therefore, there exists a need for a contact lens holding device which is inexpensive to manufacture, which minimizes or eliminates assembly problems, and which is of sturdy construction. Such device would enable the manufacture of a practical, low cost disposable disinfection system, which to date has not been available.

BRIEF DESCRIPTION OF THE INVENTION

The contact lens holding device of the present invention is a single-molded piece, and includes a dividing portion having first and second surfaces, a first basket 40 portion integrally attached to and capable of folding into closable engagement with the first surface of the dividing portion to form a first lens enclosure, and a second basket portion integrally attached to and capable of folding into closable engagement with the second surface of the dividing portion to form a second lens enclosure. The first and second basket portions are each attached to the side edge of the dividing portion by living hinges, which are also integral portions of the device.

The device lies on a single plane when in unfolded form; that is, when the first and second basket portions are not in closed engagement with the dividing portion. This provides the ability to mold the device as a single piece on a single-molding plane, thereby greatly reducing the cost of manufacture and eliminating the above-mentioned problems associated with multiple component assemblies. In fact, unlike prior assemblies, the integral nature of the present device allows the manufacturer to eliminate assembling costs by placing the device in unfolded form within packages of disinfecting solution. Also, the elimination of snap-fitting parts results in a contact lens holding device which is less likely to break. For at least the above reasons, the present invention allows for an economically practical disposable contact lens disinfecting system.

DETAILED DESCRIPTION OF THE INVENTION

The present invention relates to a contact lens holding device 10 which is a single-molded piece, and which is well suited for use as part of a disposable contact lens disinfecting system 48.

Figure 1:
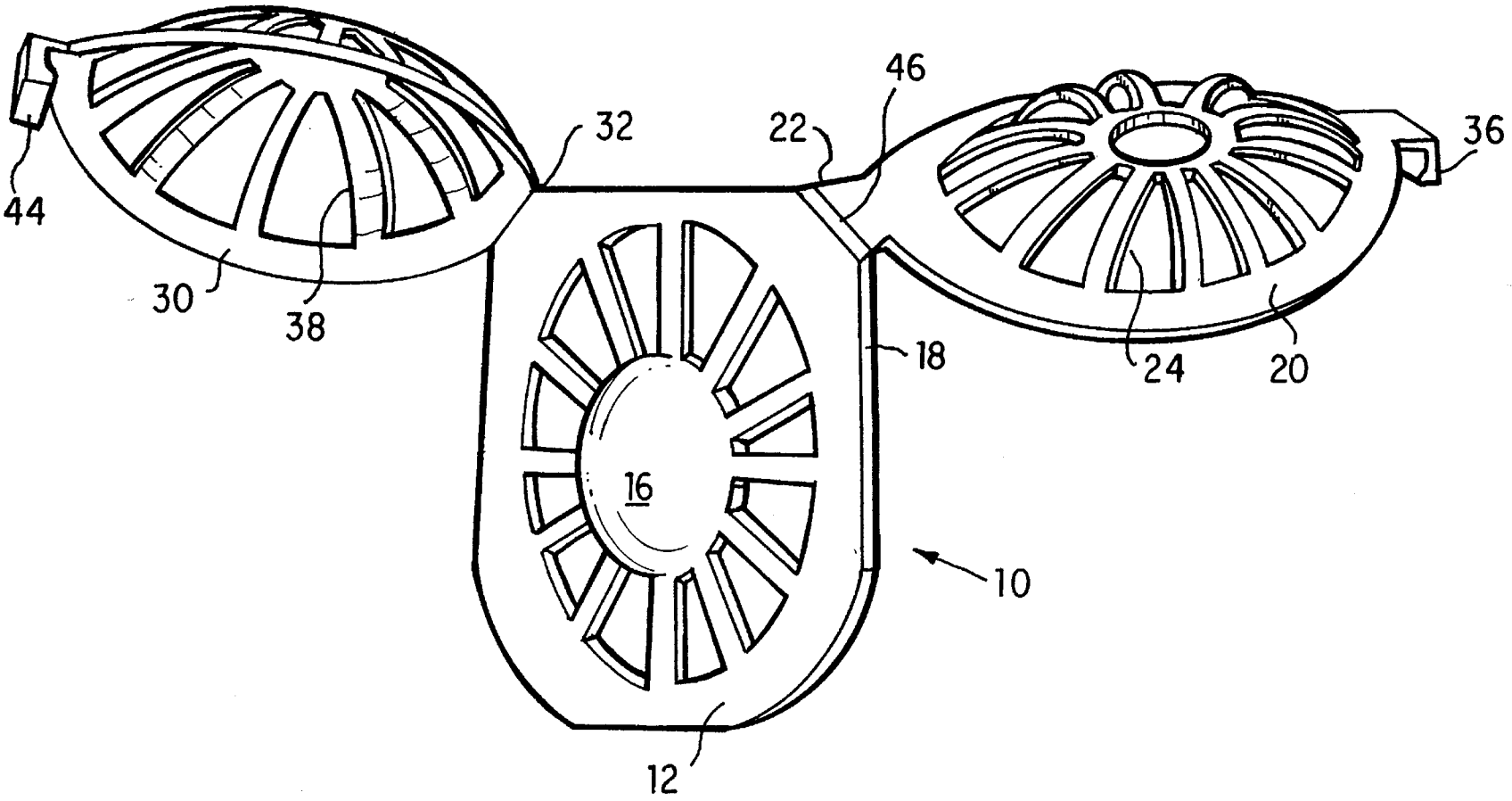
FIG. 1 is a perspective view of a contact lens holding device according to the present invention in a partially folded configuration.
Figure 2:
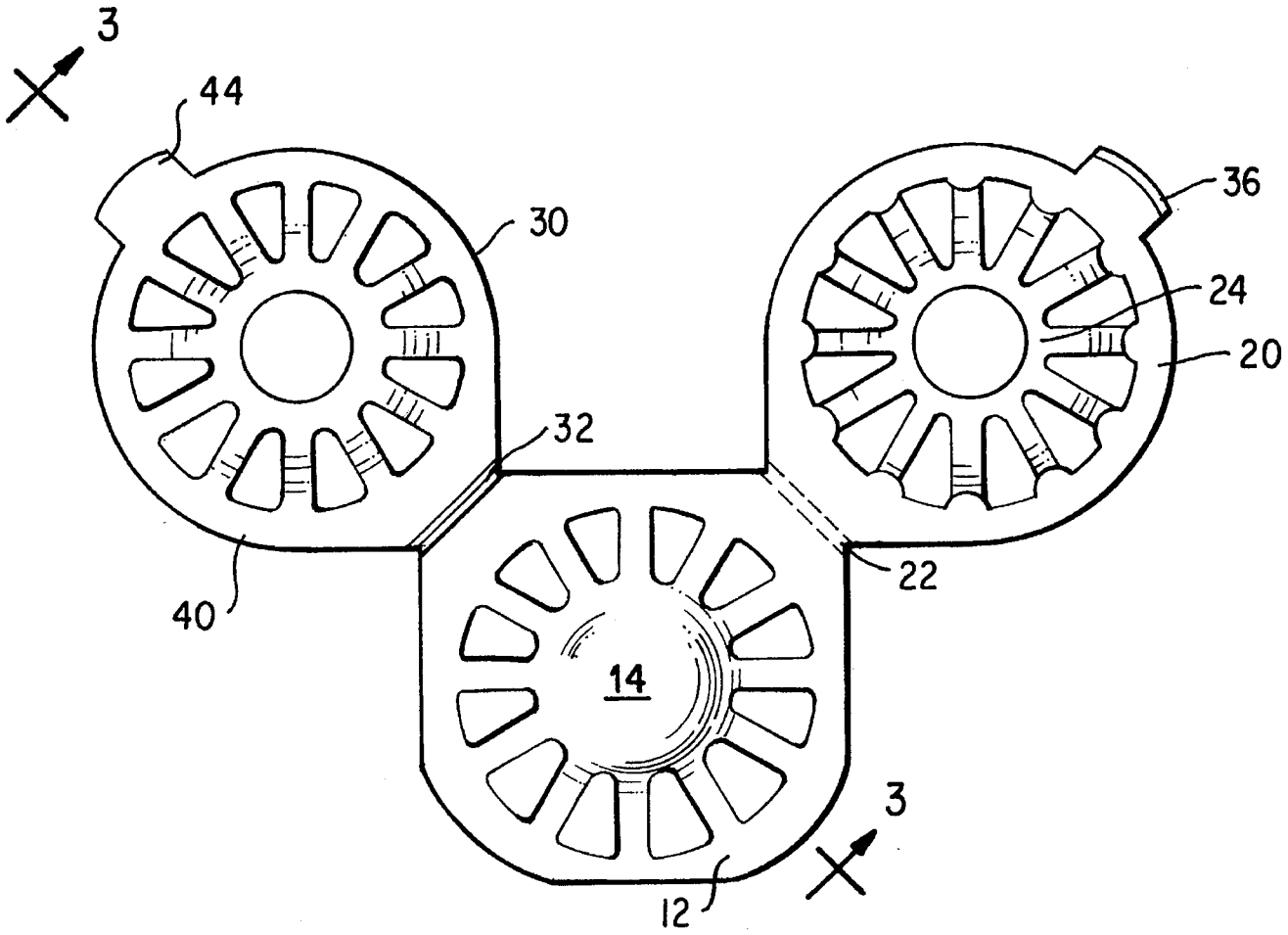
FIG. 2 is a top view of a contact lens holding device according to the present invention in an unfolded configuration.
Figure 3:
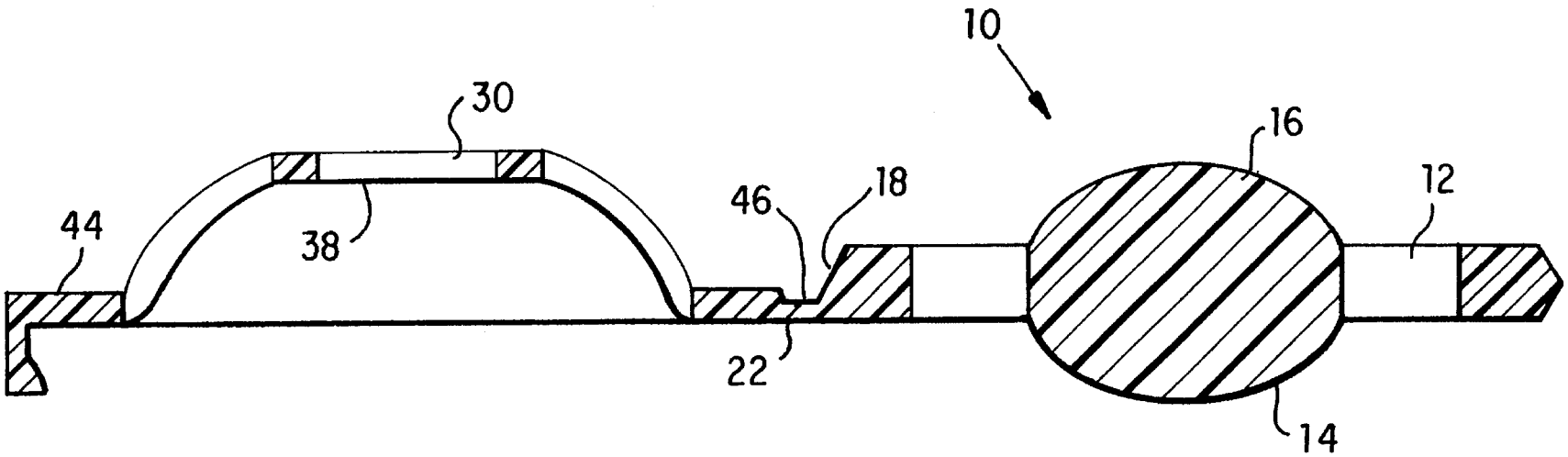
FIG. 3 is a side view of a contact lens holding device according to the present invention in an unfolded configuration taken along line B—B.

FIG. 1 shows the contact lens holding device 10 of the present invention in a partially folded configuration. FIGS. 2 and 3 show the device 10 in unfolded configuration, such as exists when the device 10 is removed from a mold. The device 10 includes a disc-like dividing portion 12 having a first surface 14 and a second surface 16 separated by a side edge 18. Preferably, the first and second surfaces 14, 16 are each convex to coincide with the concave surface of a contact lens and have a plurality of holes for allowing passage of disinfecting solution through its body.

A first basket portion 20 is integrally attached to the side edge 18 of the dividing portion 12 by a first living hinge 22. The first basket portion 20 has a concave interior wall 24 and an opening 26. The first basket portion 20 is capable of being folded, in the direction of its open side 26, into closable engagement with the first surface 14 of the dividing portion 12 to form a first lens enclosure 28. The first basket portion 20 preferably has holes for allowing disinfecting solution to pass through to a lens in the first enclosure 28. Likewise, a second basket portion 30 has a concave interior surface 38 and is integrally attached to the side edge 18 of the dividing portion 12 by a second living hinge 32 at a position other than that occupied by the first basket member (and stem 34, if present). A first hook-like latch 36 is provided on the first basket portion 20 at a position opposite the first living hinge 22 for securing the attachment of the first basket portion 20 to the first surface 14 when the device 10 is in folded position. The second basket portion 30 is capable of being folded, in the direction of its open side 40, into closable engagement with the second surface 16 of the dividing portion 12 to form a second lens enclosure 42. The second basket portion 30 also preferably has holes for allowing disinfecting solution to pass through a lens in the second enclosure 42. A second hook-like latch 44 is provided on the second basket portion 30 at a position opposite the second living hinge 32 for securing the attachment of the second basket portion 30 to the second surface 16 when the device 10 is in folded position.

The first living hinge 22 allows the first basket portion 20 to fold towards and upon the first surface 14 of the dividing portion 12. Likewise, the second living hinge 32 allows the second basket portion 30 to fold towards and upon the second surface 16 of the dividing portion 12. Each living hinge 22, 32 preferably is formed by a furrow or channel 46 extending between the length of attachment of its respective basket portion 18, 20 and the dividing portion 12 over which the basket portion folds. For this reason, the device 10 should be made of a material which is strong enough to withstand the disinfection process and everyday misuse, but flexible enough to allow folding at the living hinges 22, 32 and engagement by the latches 36, 44. Polypropylene and polyethylene are examples of materials which meet the needs of the invention.

As illustrated in FIGS. 2 and 3, when the device 10 of the present invention is in unfolded position, the dividing portion 12, the first basket portion 20, the second basket portion 30, both living hinges 22, 32, and the stem 34 if present, all lie on substantially the same plane. This enables the device 10 to be manufactured in a single molding step, and provides the advantages described above.

Means for maintaining the device 10 in stable position within a disinfection system 48 may also be provided. The stabilizing means may be a stem 34 attached at a first end to the dividing portion 12 at a position along the side edge 18 of the dividing portion 12 not occupied by either of the basket portions 20, 30 and having means for attaching to the cap 52 or other stabilizing portion of a disinfecting system container 34 at the opposite end. The longitudinal axis of the stem 34 is preferably in an identical plane with the longitudinal axis of the dividing portion 12. There must also be sufficient space between the stem 34 and the basket portions 20, 30 to allow folding of the device 10 without interference.

Figure 5:
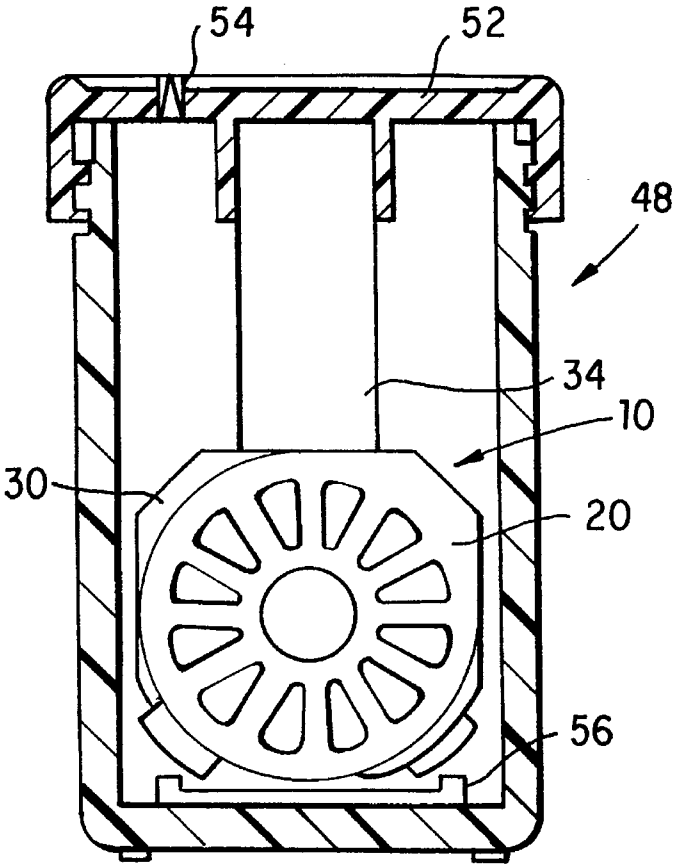
FIG. 5 is front elevation view of a contact lens holding device according to the present invention in a use in a disinfecting system.
Figure 4:
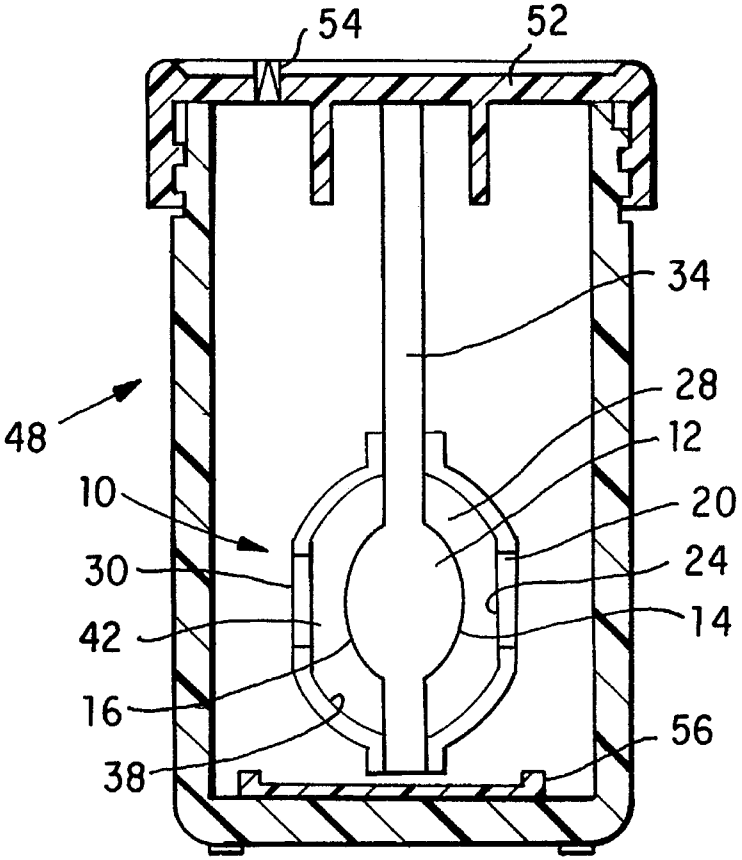
FIG. 4 is a side elevation view of a contact lens holding device according to the present invention in a use in a disinfecting system.

FIGS. 4 and 5 show the device 10 in completely folded position and in use within a disinfecting system 48. The device 10 is inside a disinfecting cup 50 and is attached by its stem 34 to a container cap 52 having a vent 54. A catalytic disc 56 for neutralizing hydrogen peroxide is provided below the device 10. A first contact lens is located inside the first enclosure and a second contact lens is located inside the second enclosure 42. Once the disinfecting process is completed, the device 10 is removed from the cup 50, the basket portions 20, 30 moved back into substantially unfolded position, and the lenses removed.

What is claimed is:

1. A contact lens holding device, including a component molded in a single step, said component comprising:

(a) a dividing portion having first and second surfaces, said surfaces facing in substantially opposite directions;

(b) a first basket portion integrally attached to, and capable of folding into closable engagement with, said first surface of said dividing portion by means of a first living hinge, in order to form a first lens-retaining enclosure;

(c) a second basket portion integrally attached to, and capable of folding into closable engagement with, said second surface of said dividing portion by means of a second living hinge, in order to form a second lens-retaining enclosure, and (d) a cap attached to said dividing portion at an end opposite said basket portions, wherein said basket portions are substantially diametrically opposed when positioned in closed engagement with said dividing portion, wherein said dividing portion, said first basket portion, said second basket portion and said living hinges are formed as a single piece during molding, and wherein said device is free of additional hinges between said dividing portion and said basket portions.

2. A contact lens holding device as recited in claim 1, wherein said living hinges are substantially free of holes therethrough.

3. A contact lens holding device as recited in claim 1, wherein said contact lens holding device is formed from a moldable polymer material.

4. A contact lens holding device as recited in claim 3, wherein said first living hinge comprises a portion of said moldable polymer material, positioned between said first basket portion and said dividing portion, having a reduced thickness relative to said first basket portion and said dividing portion; and wherein said second living hinge comprises a portion of said moldable polymer material, positioned between said second basket portion and said dividing portion, having a reduced thickness relative to said second basket portion and said dividing portion.

5. A contact lens holding device as recited in claim 4, wherein said living hinges comprise channeled portions extending between the respective basket portions and dividing portions, said channeled portions being positioned facing opposite directions, whereby each of said baskets are allowed to rotate in only one direction to closable engage with said dividing portion.

6. A contact lens holding device as recited in claim 3, wherein said moldable polymer material is selected from the group consisting of polypropylene, polyethylene, copolymers of ethylene and propylene, and mixtures thereof.

7. A contact lens holding device as recited in claim 1, wherein the first and second surfaces of the dividing portion are convex to correspond substantially with the concave surface of a contact lens.

8. A contact lens holding device as recited in claim 1, further comprising means for engagably closing said first and second basket portions to the dividing portion.

9. An apparatus for disinfecting contact lenses with a disinfecting solution, said apparatus comprising a container capable of holding said disinfecting solution, means for sealing the container, and a contact lens holding device for retaining at least one contact lens inside the container during disinfection, said holding device including a component molded in a single step, said component comprising:

(a) a dividing portion having first and second surfaces, said surfaces facing in substantially opposite directions;

(b) a first basket portion integrally attached to, and capable of folding into closable engagement with, said first surface of said dividing portion by means of a first living hinge, in order to form a first lens-retaining enclosure;

(c) a second basket portion integrally attached to, and capable of folding into closable engagement with, said second surface of said dividing portion by means of a second living hinge, in order to form a second lens-retaining enclosure, and (d) a cap attached to said dividing portion at an end opposite said basket portions, wherein said basket portions are substantially diametrically opposed when positioned in closed engagement with said dividing portion, wherein said dividing portion, said first basket portion, said second basket portion and said living hinges are formed as a single piece during molding, and wherein said device is free of additional hinges between said dividing portion and said basket portions.

10. An apparatus as recited in claim 9, wherein said living hinges are substantially free of holes therethrough.

11. An apparatus as recited in claim 9, wherein said contact lens holding device is formed from a moldable polymer material.

12. An apparatus as recited in claim 11, wherein said first living hinge comprises a portion of said moldable polymer material, positioned between said first basket portion and said dividing portion, having a reduced thickness relative to said first basket portion and said dividing portion; and wherein said second living hinge comprises a portion of said moldable polymer material, positioned between said second basket portion and said dividing portion, having a reduced thickness relative to said second basket portion and said dividing portion.

13. An apparatus as recited in claim 12, wherein said living hinges comprises channeled portions extending between the respective basket portions and dividing portion, said channeled portions being positioned facing opposite directions, whereby each of said baskets are allowed to rotate in only one direction to closably engage with said dividing portion.

14. An apparatus as recited in claim 11, wherein said moldable polymer material is selected from the group consisting of polypropylene, polyethylene, copolymers of ethylene and propylene, and mixtures thereof.

15. An apparatus as recited in claim 9, wherein the first and second surfaces of the dividing portion are convex to correspond substantially with the concave surface of a contact lens.

16. An apparatus as recited in claim 9, further comprising means for engagably closing said first and second basket portions to the dividing portion.

17. An apparatus as recited in claim 9, further comprising a disinfecting solution including hydrogen peroxide and a catalyst for neutralizing the hydrogen peroxide.

* * * * *